United States Patent [19]

Nanjo et al.

[11] 4,214,566

[45] Jul. 29, 1980

[54] IGNITION SYSTEM FOR AN INTERNAL COMBUSTION ENGINE

[75] Inventors: Hirotoshi Nanjo, Susono; Katsuo Murakami, Numazu, both of Japan

[73] Assignee: Kokusan Denki Co., Ltd., Numazu, Japan

[21] Appl. No.: 938,887

[22] Filed: Sep. 1, 1978

[30] Foreign Application Priority Data

Sep. 14, 1977 [JP] Japan ..... 52-123847[U]

[51] Int. Cl.[2] ..... F02P 1/00

[52] U.S. Cl. ..... 123/594; 315/209 SC; 315/218

[58] Field of Search ..... 123/148 E, 149 A, 149 D, 123/148 AC; 310/70 A; 315/218, 209 SC

[56] References Cited

U.S. PATENT DOCUMENTS

| | | | |
|---|---|---|---|
| 3,622,837 | 11/1971 | Gellman | 315/209 SC |
| 3,877,453 | 4/1975 | Brungsberg | 123/148 E |
| 3,961,613 | 6/1976 | Canup | 123/148 E |
| 4,034,731 | 7/1977 | Sato | 123/148 E |
| 4,074,669 | 2/1978 | Cavil et al. | 315/218 |
| 4,119,076 | 10/1978 | Sato | 123/148 E |

*Primary Examiner*—Charles J. Myhre
*Assistant Examiner*—Raymond A. Nelli
*Attorney, Agent, or Firm*—Pearne, Gordon, Sessions

[57] ABSTRACT

An ignition system for an internal combustion engine comprises a primary current control switch provided in parallel with an exciter coil and the primary of the ignition coil, energized by an exciter coil producing an AC voltage in time with rotation of the engine crank shaft. The primary current control switch is made conductive in advance of the ignition angle to permit a current to flow therethrough, and is made nonconductive at the ignition angle to cause sudden increase in the primary current. The ignition system is characterized in that the core of the ignition coil has a magnetic retentivity and by comprising resistor means for providing a path for a current through the primary in the opposite direction to the current which flows through the primary at the ignition angle.

7 Claims, 10 Drawing Figures

IGNITION SYSTEM FOR AN INTERNAL COMBUSTION ENGINE

BACKGROUND OF THE INVENTION

The present invention relates to an ignition system for an internal combustion engine, and particularly to an ignition system comprising a primary current control switch provided in parallel with an exciter coil and the primary of an ignition coil energized by an exciter coil producing an AC voltage in time with the rotation of the engine crankshaft, the primary current control switch being made conductive in advance of the ignition angle and made nonconductive at the ignition angle to cause sudden increase in the primary current.

Ignition systems of this type rely on a principle wherein the primary current variation is accompanied by the variation in the magnetic flux in the core of the ignition coil and the larger magnetic flux variation results in the higher secondary voltage and the larger spark energy. In certain applications, the primary current variation is insufficient, and hence the magnetic flux variation is insufficient, and accordingly the magnitude of the secondary voltage and the magnitude of the spark energy are insufficient.

SUMMARY OF THE INVENTION

An object of the present invention is to enhance the spark energy produced at the ignition plug.

An ignition system for an internal combustion engine comprises an ignition coil having a primary winding and a secondary winding wound upon a magnetic core, an exciter coil producing an AC voltage in synchronism with rotation of the engine and connected to the primary winding of the ignition coil to supply the AC voltage to the primary winding. A primary current control switch is connected in parallel with an exciter coil and the primary winding, and is made conductive in advance of the ignition angle of the engine to short-circuit the exciter coil, permitting a short-circuit current flow therethrough. At the ignition angle, the primary current control switch is changed from conductive state to nonconductive state to cause a sudden increase in the primary current to induce a high voltage in the secondary, thereby firing the ignition plug. The primary current control switch may comprise a semiconductor switching element such as a transistor. The ignition system is characterized in that the core of the ignition coil has a magnetic retentivity (residual magnetism) and by further comprising resistor means for providing a path for current through the primary winding in a direction opposite to the current which flows through the primary winding at the ignition angle.

As the core of the ignition coil has a high magnetic retentivity, the magnetic flux in the core has a negative value immediately before the ignition angle, because of the negative current which has flowed during the preceding half cycle. At the ignition angle, the primary current is increased and accordingly the magnetic flux is increased. Since the magnetic flux begins to change from a negative value, the magnetic flux variation is larger than if the change begins at the zero value as is the case with a core having no magnetic retentivity. As a result, a larger secondary voltage and hence a larger spark energy are obtained.

BRIEF DESCRIPTION OF THE DRAWINGS

Other features and advantages of the invention will be apparent from the following description taken in conjunction with the accompanying drawings, in which.

DETAILED DESCRIPTION OF THE PREFERRED EMBODIMENTS

Figure 1:
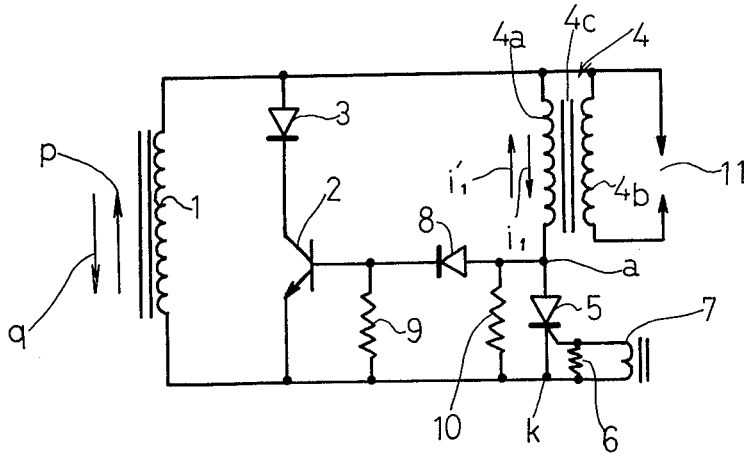
FIG. 1 shows a circuit diagram of an ignition system of an embodiment of the invention.
Figure 2:
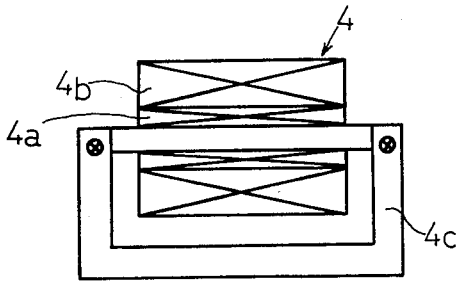
FIG. 2 shows a cross sectional view of an example of an ignition coil which may be incorporated in the ignition system of the invention.

Referring now more particularly to FIGS. 1 and 2, there is shown an embodiment of the invention. The ignition system of this embodiment comprises an exciter coil 1 provided in a magneto generator driven by the internal combustion engine to produce an AC voltage in synchronism with rotation of the engine. The ignition system further comprises an ignition coil 4 including a primary winding **4*a* and a secondary winding 4*b* wound upon a magnetic core 4*c* (FIG. 2). A thyristor 5 is connected in series with the primary winding 4*a*. More particularly, the anode of the thyristor 5 is connected to a first end of the primary winding 4*a* to form a series circuit with the primary winding 4*a*. The series circuit of the primary winding is connected across the exciter coil 1. The second end of the primary winding 4*a* is connected to one end of the secondary winding 4*b*. An ignition plug 11 is connected across the secondary winding 4*b* of the ingition coil 4. A primary current control switch is in the form of a transistor 2 having its emitter connected to the cathode of the thyristor 5, having its collector connected through a diode 3 to the second end of the primary winding 4*a*, and having its base connected through a diode 8 to the anode a of the thyristor 5. A resistor 6 and a signal source 7 are connected across the gate and the cathode of the thyristor 5. The signal source 7 may be any of conventional ones which generates an ignition timing signal at the ignition angle of the engine, and is normally a generating coil of a signal generator operating in synchronism with the engine. An example of the signal generator is a combination of a signal magnetic pole formed by extending part of a magnetic pole of a flywheel magneto generator through the peripheral wall of the flywheel, with the end of the signal magnetic pole being exposed outside of the flywheel, and a signal coil provided to cooperate with the exposed end of the signal magnetic pole as the flywheel rotates. A resistor 9 is connected across the base and emitter of the transistor 2. Connected across the anode a and the cathode k of the thyristor 5 is a resistor 10, which serves to provide a path for a current through the primary winding 4*a* in a direction opposite to the current which flows through the primary winding 4*a*** at the ignition angle.

The core 4*c* of the ignition coil 4 has a magnetic retentivity. In the preferred embodiment, the core 4*c* is made up of laminated silicon steel sheets and is constructed to form a closed magnetic path to have a sufficient magnetic retentivity (residual magnetism).

As the exciter coil 1 produces a voltage of a polarity indicated by an arrow P, a current flows through the primary winding 4*a* and the diode 8 to the base of the transistor 2, to render the transistor 2 conductive. When the transistor 2 is conductive, most of the current flowing out of the exciter coil 1 flows through the transistor 2 as the resistance of the resistor 10 is sufficiently high. Thus, the transistor 2 short-circuits the exciter coil 1, permitting a large short-circuiting current flow therethrough. Subsequently, at the ignition angle, the output of the signal source 7 reaches a level sufficient to turn on the thyristor 5, and hence the thyristor, being positively biased, conducts. Upon conduction of the thyristor 5, the base to emitter voltage of the transistor 2 becomes zero and the base current is interrupted, so that the transistor 2 is changed to nonconductive state. The resultant change of the current induces a high voltage in the exciter coil 1 in a direction indicated by P. Since the thyristor 5 is now conductive, the induced high voltage is applied across the primary winding 4*a* and a large current $i_1$ to flow through the primary winding 4*a*, the current $i_1$ having a high rate of increase, and, as a result, a high voltage is induced in the secondary winding 4*b* to fire the ignition plug. The magnitude of the secondary voltage depends on the variation of the magnetic flux per unit of time in the core 4*c* of the ignition coil 4.

Figure 4A:
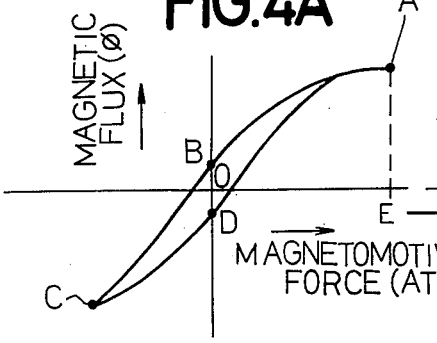
FIGS. 4A through 4C show various diagrams for illustrating the operation of the ignition system of FIG. 1.
Figure 4B:
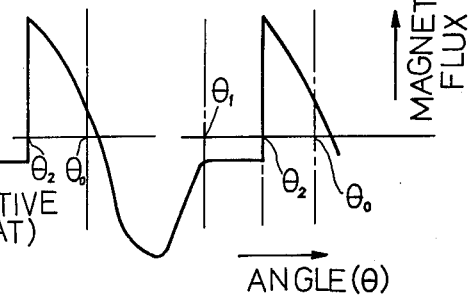
Figure 4C:
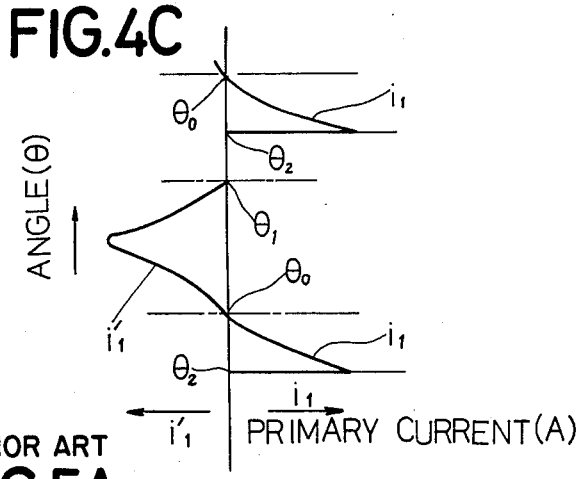

FIGS. 4A through 4C illustrates the operation of the ignition system described above. FIG. 4A shows a hysteresis loop or B-H curve of a magnetic flux $\phi$ in the core 4*c* relative to the magnetomotive force AT. FIGS. 4B and 4C respectively show a magnetic flux $\phi$ in the core 4*c*, and a current $i_1$, $i'_1$ flowing through the primary winding 4*a* relative to the rotational angle $\theta$. Operation of the ignition system is repetitive, and may therefore be described starting at any point. Assuming that ignition is effected, the primary current $i_1$ is gradually decreased and is terminated at an angle $\theta_0$. Because of the retentivity of the core, the operating point of the magnetic flux $\phi$ is at B on the hysteresis loop. The exciter coil 1 then produces a negative output, as indicated by an arrow q. The resistor 10 provides a path for the negative current $i_1'$ through the primary winding 4*a*. As the negative primary current $i'_1$ flows, the magnetic flux $\phi$ in the core is changed from B to C, and to D. At the angle $\theta_1$, the negative current $i'_1$ is terminated, and the output of the exciter coil 1 goes positive. At this moment, the transistor 2 is turned on and most of the output current from the exciter coil 1 flows through the transistor 2, and therefore the magnetic flux $\phi$ in the core 4*c* remains at D on the hysteresis loop. At the ignition angle $\theta_2$, the transistor 2 is turned off and a large current $i_1$ begins to flow through the primary winding 4*a* of the ignition coil, and hence the magnetic flux in the core 4*c* changes from D to A. The change in magnetic flux induces a high voltage in the secondary 4*b*.

Figure 5A:
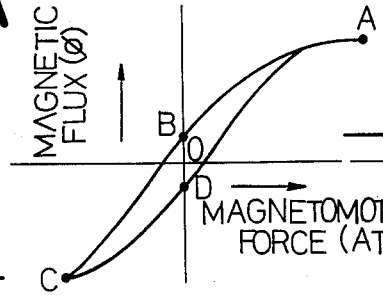
PRIOR ART FIG.5A
FIGS. 5A through 5C show the equivalent diagrams of an ignition system wherein a current through the primary winding is limited to one direction.
Figure 5B:
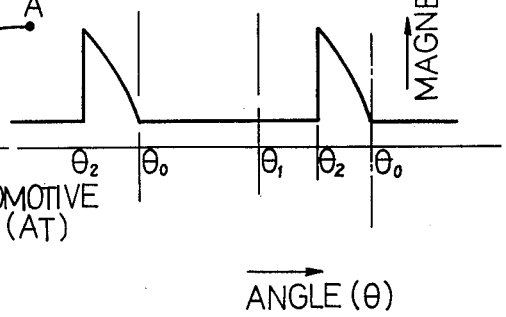
PRIOR ART FIG.5B
Figure 5C:
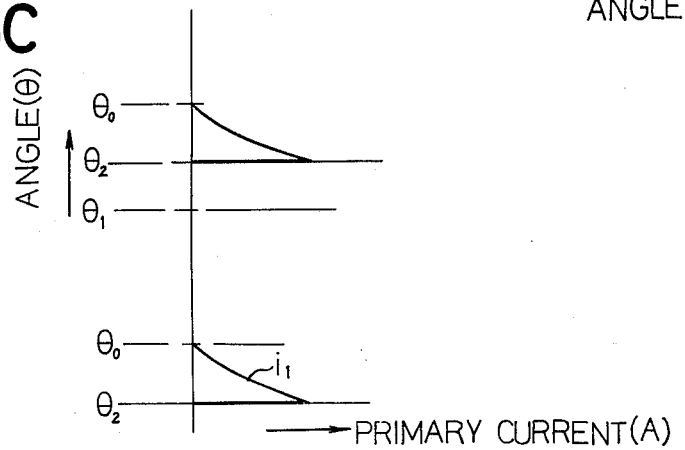
PRIOR ART FIG.5C

If the resistor 10 were not provided, the operation of the circuit would be as illustrated in FIGS. 5A through 5C. The exciter coil's output of the negative polarity (q) would be blocked by the thyristor 5 and the diode 8. Accordingly, the magnetic flux in the core would remain at B during the period from $\theta_1$ to $\theta_2$. As a result, the change in the magnetic flux in the core at the ignition angle $\theta_2$ would be from B to A.

It will now be understood that the inserted resistor 10 permits a current $i'_1$ opposite in direction to the current $i_1$ which flows at the ignition angle, and the magnetic flux change at the ignition angle is increased by an amount of $\overline{OB}+\overline{OD}$, compared to a system wherein the resistor 10 is not provided. As shown in FIG. 4A or 5A, the flux change is caused by the change of magnetomotive force AT. Therefore the period dt during which the flux $\phi$ changes from D to A or B to A is equal to the period during which the magnetomotive force AT changes from O to E. As the number of turns on the primary winding 4*a* of the ignition coil is constant, the necessary primary current to change the magnetomotive force from O to E is unchangeable. Though the period during which the primary current changes from zero to a maximum value corresponding to the magnetomotive force E is a function of the inductance of the circuit, the change of the period may be deemed to be negligible compared to the change of the amount of the flux change from $\overline{BA}$ to $\overline{DA}$. Therefore the period dt during which the flux $\phi$ changes from B to A is the same as the period during which the flux $\phi$ changes from D to A. As a result, increase in the magnetic flux change obtained by the present invention causes the rate of change of flux with time (i.e., $d\phi/dt$) to increase and increase in the rate of the flux change leads to increase in the output voltage of the ignition coil. Increase in the magnetic flux change leads to increase in the spark energy.

Figures 3A, 3B:
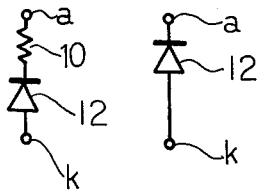
FIGS. 3A and 3B respectively show modifications of the device for providing a path for a current through the primary winding of the ignition coil in the opposite direction to the current which flows through the primary winding at the ignition angle.

As an alternative to the resistor 10, a series circuit of a resistor 10 and a diode 12 as shown in FIG. 3A may be used. In addition, as shown in FIG. 3B, the internal resistance of a diode 12 may be used as resistor means for providing a path permitting a current in the opposite direction to the current at the ignition angle with low revolution speed.

The ignition coil is not limited to the one shown in FIG. 2, but may be those comprising a bar-shaped core of laminated iron sheets which has a magnetic retentivity.

The present invention is also applicable to other types of ignition systems including a primary current control switch provided in parallel with the exciter coil and the primary winding of the ignition coil wherein the primary current control switch is changed from conductive to nonconductive state at the ignition angle. The primary current control switch may be other types of switching devices, such as thyristors.

While there have been described what are at present considered to be the preferred embodiments of this invention, it will be obvious to those skilled in the art that various changes and mmodifications may be made therein without departing from the invention, and it is aimed, therefore, in the appended claims to cover all such changes and modifications as fall within the true spirit and scope of the invention.

What is claimed is:

1. An ignition system for an internal combustion engine, comprising: an ignition coil having a primary winding and a secondary winding wound upon a magnetic core having magnetic retentivity, an exciter coil producing an AC voltage in synchronism with rotation of the engine and connected to said primary winding of said ignition coil to supply the AC voltage to said primary winding, a primary current control switch connected in parallel with the exciter coil and the primary winding of the ignition coil and adapted to be made conductive immediately when an output of the exciter coil changes to a given polarity to permit a current to flow therethrough and changed from conductive state to nonconductive state at the ignition angle to cause a sudden increase in the primary winding current to induce a high voltage in said secondary winding, thereby firing the ignition plug, characterized in that said ignition system further comprises resistor means for providing a path, when the exciter coil is of opposite polarity, for a current through said primary winding in a direction opposite to the current which flows through the primary winding at the ignition angle to reset the flux in the core, intermediate successive ignition angles, to a value below the abscissa on the B-H curve.

2. An ignition system as set forth in claim 1, wherein said primary current control switch comprises a semiconductor switching element.

3. An ignition system as set forth in claim 1, wherein said primary current control switch comprises a transistor.

4. An ignition system as set forth in claim 1, further comprising a thyristor having its anode connected to a first end of said primary winding to form a series circuit with said primary winding, said series circuit being connected across said exciter coil, wherein said primary current control switch comprises a transistor having its emitter coupled to the cathode of said thyristor, having its collector coupled to the second end of said primary winding and having its base coupled to the anode of said thyristor.

5. An ignition system as set forth in claim 4, wherein said resistor means for providing a path comprises a resistor connected across the anode and the cathode of said thyristor.

6. An ignition system as set forth in claim 1, wherein said core of said ignition coil is constructed to form a closed magnetic path.

7. An ignition system as set forth in claim 6, wherein said core is formed of laminated silicon steel sheets.

* * * * *